US007161290B2

(12) United States Patent
Takenaka et al.

(10) Patent No.: US 7,161,290 B2
(45) Date of Patent: Jan. 9, 2007

(54) IMAGE DISPLAY APPARATUS

(75) Inventors: Shigeo Takenaka, Fukaya (JP); Masaru Nikaido, Yokosuka (JP); Sachiko Hirahara, Fukaya (JP); Satoko Oyaizu, Fukaya (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/921,326

(22) Filed: Aug. 19, 2004

(65) Prior Publication Data

US 2005/0077812 A1 Apr. 14, 2005

Related U.S. Application Data

(63) Continuation of application No. PCT/JP03/01489, filed on Feb. 13, 2003.

(30) Foreign Application Priority Data

Feb. 19, 2002 (JP) ..... 2002-041711

(51) Int. Cl.
*H01J 29/02* (2006.01)

(52) U.S. Cl. ..... 313/497; 345/75.2

(58) Field of Classification Search ..... 313/495–497, 313/292, 238, 243, 244, 249, 250; 345/74.1, 345/75.2; 315/169.1, 169.3
See application file for complete search history.

(56) References Cited

U.S. PATENT DOCUMENTS

| | | | | |
|---|---|---|---|---|
| 5,347,292 | A * | 9/1994 | Ge et al. | 345/75.2 |
| 5,543,691 | A * | 8/1996 | Palevsky et al. | 315/366 |
| 5,708,325 | A * | 1/1998 | Anderson et al. | 313/495 |
| 5,811,927 | A * | 9/1998 | Anderson et al. | 313/495 |
| 5,864,205 | A * | 1/1999 | Dworsky | 313/495 |
| 6,008,595 | A * | 12/1999 | Fink et al. | 315/308 |
| 2002/0036460 | A1 | 3/2002 | Takenaka et al. | |

FOREIGN PATENT DOCUMENTS

| | | | |
|---|---|---|---|
| JP | 3-149728 | | 6/1991 |
| JP | 03149728 | A * | 6/1991 |
| JP | 6-310059 | | 11/1994 |
| JP | 10-83778 | | 3/1998 |
| JP | 2000-67773 | | 3/2000 |
| JP | 2000-243319 | | 9/2000 |
| JP | 2000-251806 | | 9/2000 |
| JP | 2000243319 | A * | 9/2000 |
| JP | 2000251806 | A * | 9/2000 |
| JP | 2001-76652 | | 3/2001 |

(Continued)

*Primary Examiner*—Ashok Patel
*Assistant Examiner*—Christopher M. Raabe
(74) *Attorney, Agent, or Firm*—Oblon, Spivak, McClelland, Maier & Neustadt, P.C.

(57) ABSTRACT

An envelope includes a first substrate having an image display surface, and a second substrate opposing the first substrate with a space therebetween. Electron sources for activating the image display surface are arranged on the second substrate at a predetermined pixel pitch in an X-direction and a Y-direction perpendicular to each other. Spacers are provided between the first and second substrates. The spacers are arranged at several times the pixel pitch in the X-direction, and arranged in the Y-direction at the same pitch as the pixel pitch at least in a part of the image display surface, those of the spacers arranged in the Y-direction being arranged in line with the electron sources and being located at both sides of each of the corresponding electron sources to make an electron emitted from each of the corresponding electron sources pass between each adjacent pair of those spacers.

11 Claims, 5 Drawing Sheets

FOREIGN PATENT DOCUMENTS

| | | | |
|---|---|---|---|
| JP | 2001-272926 | | 10/2001 |
| JP | 2001-272927 | | 10/2001 |
| JP | 2001272926 A | * | 10/2001 |
| JP | 2002-198000 | | 7/2002 |
| JP | 2003-31126 | | 1/2003 |

* cited by examiner

IMAGE DISPLAY APPARATUS

CROSS-REFERENCE TO RELATED APPLICATIONS

This is a Continuation Application of PCT Application No. PCT/JP03/01489, filed Feb. 13, 2003, which was not published under PCT Article 21(2) in English.

This application is based upon and claims the benefit of priority from prior Japanese Patent Application No. 2002-041711, filed Feb. 19, 2002, the entire contents of which are incorporated herein by reference.

BACKGROUND OF THE INVENTION

1. Field of the Invention

The present invention relates to an image display apparatus equipped with substrates opposing each other and a plurality of electron sources provided on the inner surface of one of the substrates.

BACKGROUND ART

2. Description of the Related Art

Image display apparatuses for high-definition broadcasting or similar high-resolution display apparatuses are now being demanded. Concerning their screen display performance, in particular, there is a strong command for much better performance. To meet these demands, it is indispensable to flatten the screen surface and increase the resolution of the screen. It is also demanded to reduce the weight and thickness of the apparatuses.

As an image display apparatus that satisfies the above demands, attention is now paid to a flat display apparatus, such as a field emission display (hereinafter referred to as an "FED"). FEDs have a first and a second substrate opposing each other with a predetermined space therebetween. The peripheries of these substrates are attached to each other, directly or via a rectangular side wall, thereby constituting a vacuum envelope. Phosphor layers are formed on the inner surface of the first substrate, while a plurality of electron emitting elements as electron sources are provided on the inner surface of the second substrate for exciting the phosphor layer to emit light.

Further, to make the first and second substrates sufficiently resist the atmospheric pressure applied thereto, a plurality of spacers as support members are provided between the substrates. When an image is displayed on an FED, an anode voltage is applied to the phosphor layers to accelerate electron beams emitted from electron emitting elements and make them collide with the phosphor layers. As a result, phosphor substance emits light to thereby display an image.

In the FED constructed as described above, since the size of the electron emitting element is in the order of micrometers, the distance between the first and second substrates can be set to the order of millimeters. Accordingly, compared to, for example, the cathode ray tubes (CRT) used in current televisions or computer displays, resolution enhancement, weight reduction and thickness reduction of image display apparatuses can be realized.

To achieve practical display characteristics of the above-described image display apparatuses, it is desirable to use a phosphor substance similar to the standard cathode ray tubes and to set the anode voltage to several kV or more. However, the space between the first and second substrates cannot be made large in light of resolution, properties of support members, problems raised in manufacture, etc., and must be set to about 1 to 2 mm. Therefore, when electrons emitted from the second substrate collides with a phosphor surface on the first substrate, secondary electrons and reflection electrons generate and collide with the spacers provided between the substrates, with the result that the spacers may well be charged by the electric fields of the electrons. When an acceleration voltage is applied in the FED, the spacers are generally charged positively. At this time, they attract electron beams emitted from electron emitting elements, thereby deviating the electron beams from their correct paths.

As a result, mislanding of electron beams on the phosphor layers occurs, thereby degrading the color purity of a display image.

BRIEF SUMMARY OF THE INVENTION

The present invention has been developed in light of the above, and its object is to provide an image-definition enhanced image display apparatus which is capable of preventing deviation in electron beam path and improved in the dignity of display image.

DISCLOSURE OF THE INVENTION

In order to achieve the object, an image display apparatus according to an aspect of the invention comprises: a first substrate including an image display surface; a second substrate opposing the first substrate with a space therebetween, and including a plurality of electron sources arranged at a predetermined pixel pitch in an X-direction and a Y-direction perpendicular to each other, the electron sources activating the image display surface; and a plurality of spacers provided between the first substrate and the second substrate and defining the space therebetween.

The plurality of spacers are arranged at several times the pixel pitch in the X-direction, and arranged in the Y-direction at the same pitch as the pixel pitch at least in a part of the image display surface, those of the spacers arranged in the Y-direction at least in the part of the image display surface being arranged in line with the electron sources and being located at both sides of each of the corresponding electron sources to make an electron emitted from each of the corresponding electron sources pass between each adjacent pair of the those spacers.

An image display apparatus according to another aspect of the invention comprises: a first substrate including an image display surface; a second substrate opposing the first substrate with a space therebetween, and including a plurality of electron sources arranged at a predetermined pixel pitch in an X-direction and a Y-direction perpendicular to each other, the electron sources activating the image display surface; a grid including a first surface opposing the first substrate, a second surface opposing the second substrate, and a plurality of apertures opposing the electron sources, the grid being arranged between the first substrate and the second substrate; a plurality of first columnar spacers projecting from the first surface of the grid and contacting the first substrate; and a plurality of second columnar spacers projecting from the second surface of the grid and contacting the second substrate.

The first spacers and the second spacers are arranged at several-times the pixel pitch in the X-direction, at least the first spacers or the second spacers being arranged in the Y-direction at the same pitch as the pixel pitch at least in a part of the image display surface, at least the first spacers or the second spacers arranged in the Y-direction at least in the part of the image display surface being arranged in line with the electron sources and being located at both sides of each of the corresponding electron sources to hold an electron emitted from each of the corresponding electron sources between each adjacent pair of at least the first spacers or the second spacers.

In the image display apparatus constructed as above, the spacers between the first and second substrates are located at both opposite sides of each electron source in the Y-direction, to hold an electron emitted from each electron source from both sides. Accordingly, each electron is attracted by the spacers, whereby deviation of an electron beam path is compensated. As a result, each electron is prevented from being deviated from a correct path and hence can accurately land on a desired position on the image display surface. This being so, a high-definition image display apparatus, in which degradation in color purity due to mislanding of electron beams is reduced, can be acquired.

DETAILED DESCRIPTION OF THE INVENTION

Embodiments in which the present invention is applied to a surface-conduction-type electron emitting device (hereinafter referred to as an "SED") used as a flat display apparatus will be described in detail with reference to the accompanying drawings.

Figure 1:
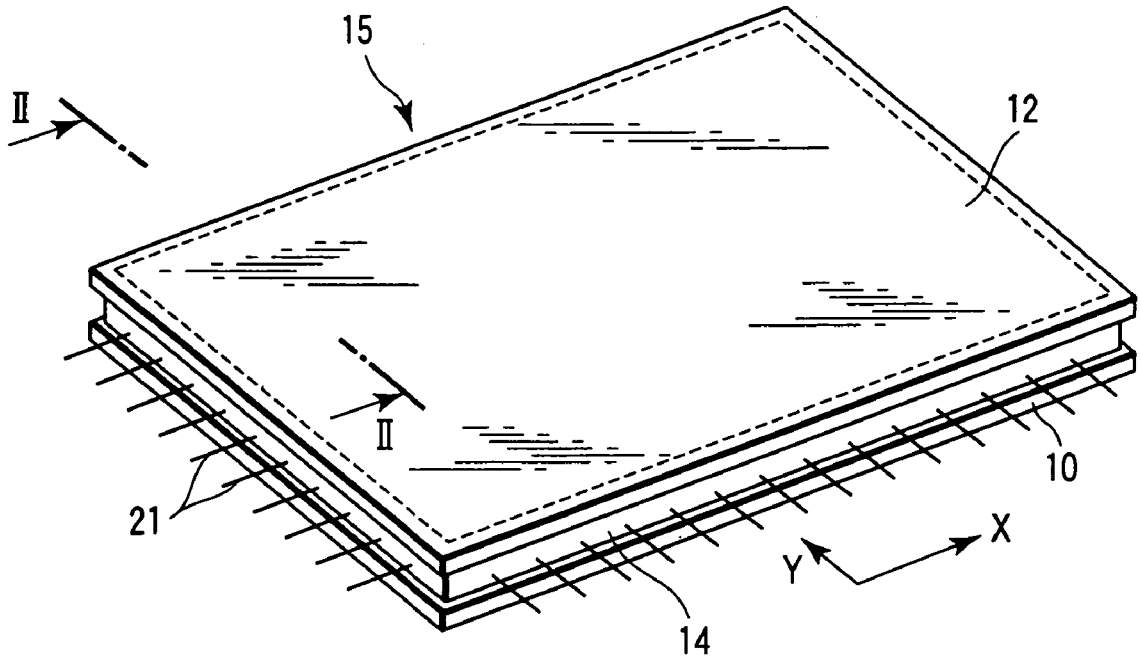
FIG. 1 is a perspective view illustrating an SED according to an embodiment of the invention.
Figure 2:
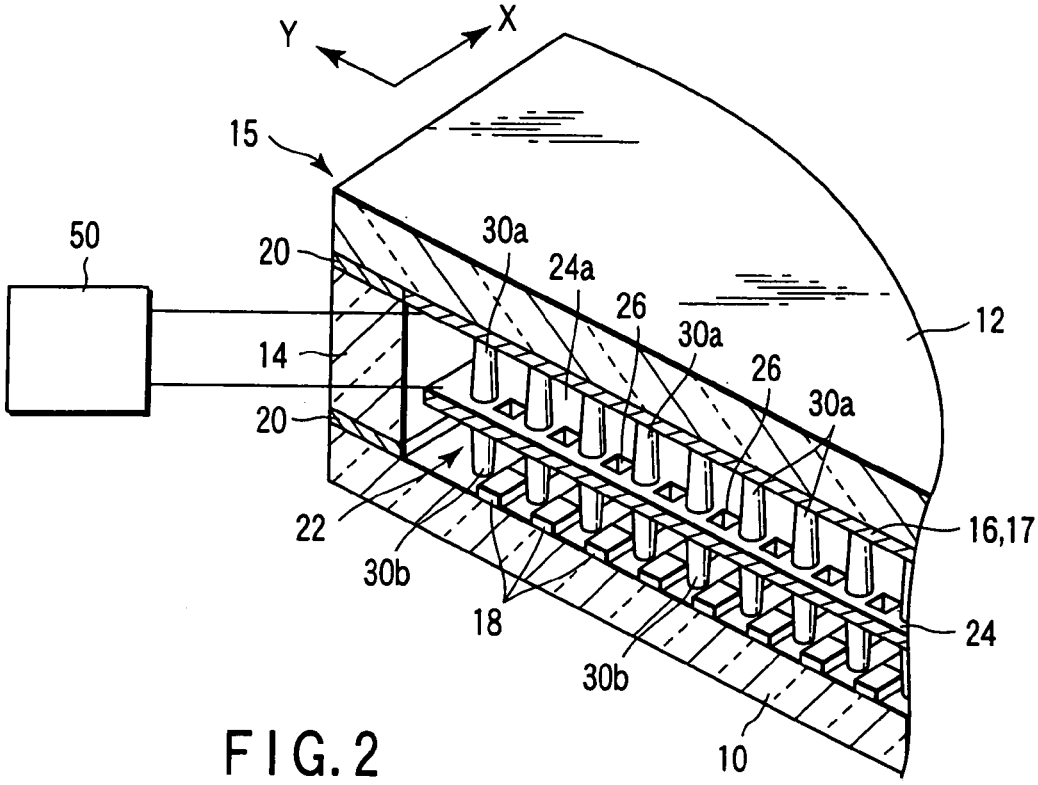
FIG. 2 is a perspective view of the SED, taken along line II—II of FIG. 1.
Figure 3:
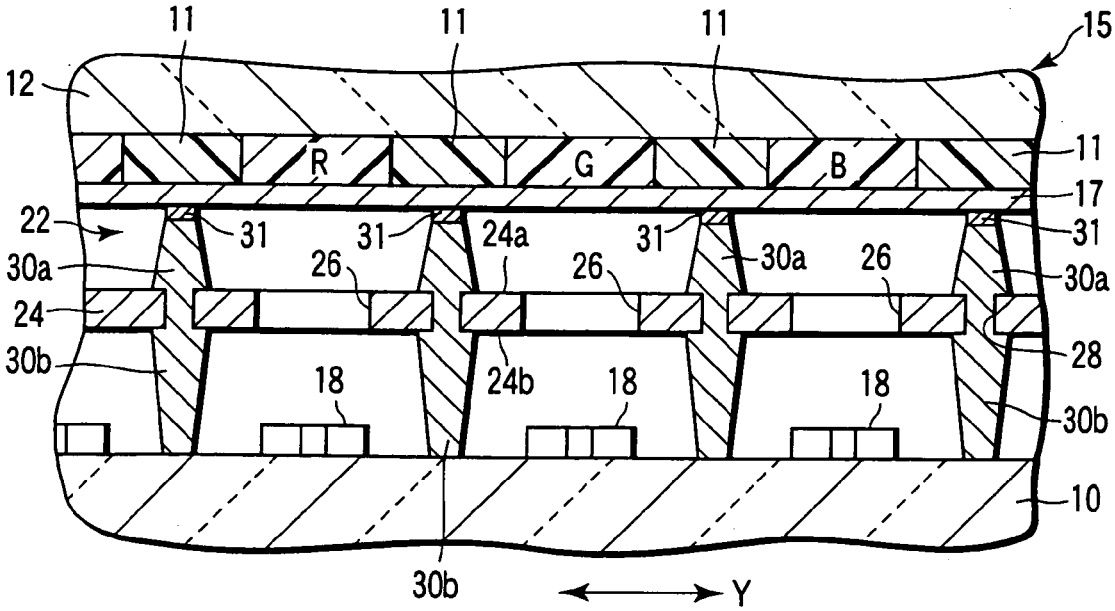
FIG. 3 is an enlarged sectional view of the SED, taken in a Y-direction.

As shown in FIGS. 1 to 3, the SED comprises a first substrate 12 and second substrate 10 as rectangular transparent glass substrates, opposing each other with a clearance of about 1.0 to 2.0 mm therebetween. The second substrate 10 is formed slightly larger than the first substrate 12. The first and second substrates 12 and 10 have their peripheries coupled to each other by a side wall 14 of a rectangular frame shape, thereby constituting a flat rectangular vacuum envelope 15.

A phosphor screen 16 serving as an image-forming surface is provided on the inner surface of the first substrate 12. The phosphor screen 16 is formed of phosphor layers R, G and B and black-colored layers 11 arranged in line, the phosphor layers R, G and B emitting light of red, blue and green, respectively, when electrons are applied thereto. These phosphor layers R, G and B are formed in dots or stripes. Further, metal back 17 formed of, for example, aluminum is formed on the phosphor screen 16. A transparent conductive film or color filter film formed of, for example, ITO may be provided between the first substrate 12 and phosphor screen.

A large number of surface-conduction-type electron emitting elements 18 for emitting respective electron beams are provided on the inner surface of the second substrate 10 as electron sources for activating the phosphor layers of the phosphor screen 16. The electron emitting elements 18 are arranged in rows and columns corresponding to respective pixels. Each electron emitting element 18 is formed of an electron emission portion, a pair of element electrodes, and the like. Further, a large number of wires 21 for applying a voltage to the respective electron emitting elements 18 are provided on the second substrate in a matrix manner, ends of the wires being lead to the outside of the second substrate.

The side wall 14 functioning as a coupling member is fixed in an airtight manner to the peripheral edges of the second substrate 10 and first substrate 12 with a sealing member 20 of, for example, low-melting-point glass or low-melting-point metal, thereby coupling the first and second substrates.

As seen from FIGS. 2 and 3, the SED incorporates a spacer assembly 22 provided between the first and second substrates 12 and 10. In this embodiment, the spacer assembly 22 comprises a plate-shaped grid 24, and a plurality of columnar spacers formed integral as one body with the opposite surfaces of the grid and protruding therefrom.

More specifically, the grid 24 has a first surface **24*a* opposing the inner surface of the first substrate 12, and a second surface 24*b* opposing the inner surface of the second substrate 10, and extends parallel to the substrates. A large number of electron-beam passage apertures 26 and spacer openings 28 are formed in the grid 24 by, for example, etching. The electron-beam passage apertures 26 are located opposing the respective electron emitting elements 18, and each of the spacer openings 28 is located between each pair of adjacent ones of electron-beam passage apertures 26** at a predetermined pitch.

The grid 24 is formed of, for example, an iron-nickel-based metal substrate with a thickness of 0.1 to 0.25 mm. An oxide film acquired by oxidizing an element contained in the metal substrate, such as $Fe_3O_4$ or $NiFe_2O_4$, is formed on the surfaces of the grid 24. Furthermore, a high-resistance film obtained by sintering a high-resistance film of glass or ceramic is also provided on the surfaces of the grid 24. The resistance of the high-resistance film is set to E+8 Ω/□ or more.

The electron-beam passage apertures 26 are in the shape of a rectangle of, for example, 0.15 to 0.25 mm×0.15 to 0.25 mm, while the spacer openings 28 have a diameter of, for example, about 0.2 to 0.5 mm. The above-mentioned high-resistance film is also provided on the inner surfaces of the electron-beam passage apertures 26 formed in the grid 24.

First spacers **30*a* are formed as one body integral with the first surface 24*a*, protruding therefrom at locations corresponding to the respective space openings 28. The distal ends of the first spacers 30*a* are in contact with the inner surface of the first substrate 12, with the metal back 17 and respective black-colored layers 11 interposed therebetween. In this embodiment, the distal ends of the first spacers 30*a* contact the metal back 17 with respective indium layers 31 interposed therebetween, the indium layers serving as height adjusting layers. The indium layers (metal layers) 31** used as height adjusting layers do not influence the paths of electron beams. The material of the height adjusting layers is not limited to a metal. It is sufficient if these layers have an appropriate hardness that can reduce variations in height between spacers.

Second spacers 30*b* are formed as one body integral with the second surface 24*b*, protruding therefrom at locations corresponding to the respective space openings 28. Their distal ends are in contact with the inner surface of the second substrate 10. Each space opening 28 and corresponding first and second spacers 30*a* and 30*b* are aligned with each other, and the corresponding first and second spacers are integrally coupled with each other through each spacer opening 28.

Each of the first and second spacers 30*a* and 30*b* is in a tapered shape in which the diameter is gradually reduced from the grid 24 toward its distal end.

For example, the proximal end of each first spacer 30*a* located at the grid 24 has a diameter of about 0.4 mm, the distal end has a diameter of about 0.3 mm, and the height is about 0.4 mm. Further, the proximal end of each second spacer 30*b* located at the grid 24 has a diameter of about 0.4 mm, the distal end has a diameter of about 0.25 mm, and the height is about 1.0 mm. Thus, the height of the first spacers 30*a* is smaller than that of the second spacers 30*b*. The height of the second spacers is set to about ⅔ or more, preferably, twice or more that of the first spacers.

Since the first and second spacers 30*a* and 30*b* are formed integral as one body, coaxially with the respective spacer openings 28, the first and second spacers are coupled to each other through the spacer openings, and formed integral with the grid 24, holding the grid 24 from both sides.

As shown in FIGS. 2 and 3, the spacer assembly 22 is arranged between the first and second substrates 12 and 10. Since the first and second spacers 30*a* and 30*b* contact the inner surface of the first and second substrates 12 and 10, they resist the atmospheric pressure applied to the substrates and keep the space between the substrates constant.

As seen from FIG. 2, the SED includes a voltage applying unit 50 for applying a voltage to the grid 24 and the metal back 17 of the first substrate 12. The voltage applying unit 50 is connected to the grid 24 and metal back 17, and applies a voltage of 12 kV to the grid 24 and a voltage of 10 kV to the metal back 17. Thus, the voltage applied to the grid 24 is higher than that to the first substrate 12, and set to, for example, 1.25 times or less the latter voltage.

A detailed description will now be given of the positional relationship between the electron emitting elements 18, electron-beam passage apertures 26, phosphor layers and spacers.

Figure 4:
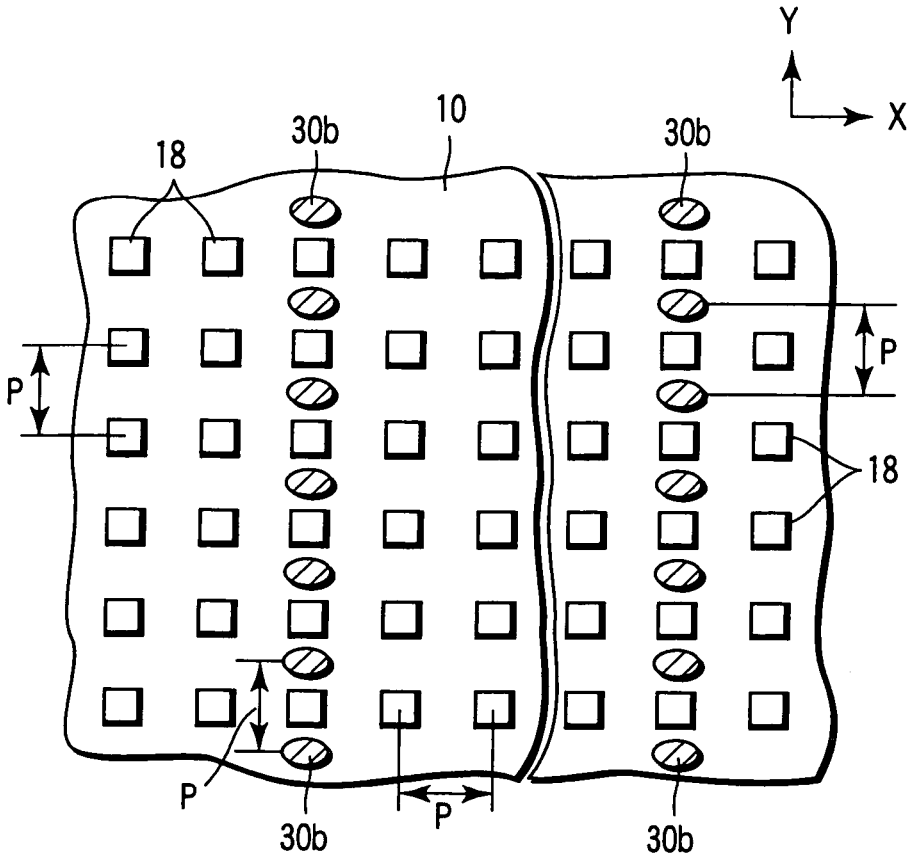
FIG. 4 is a plan view illustrating the positional relationship between the electron emitting elements, electron-beam passage apertures and spacers of the SED.
Figure 5:
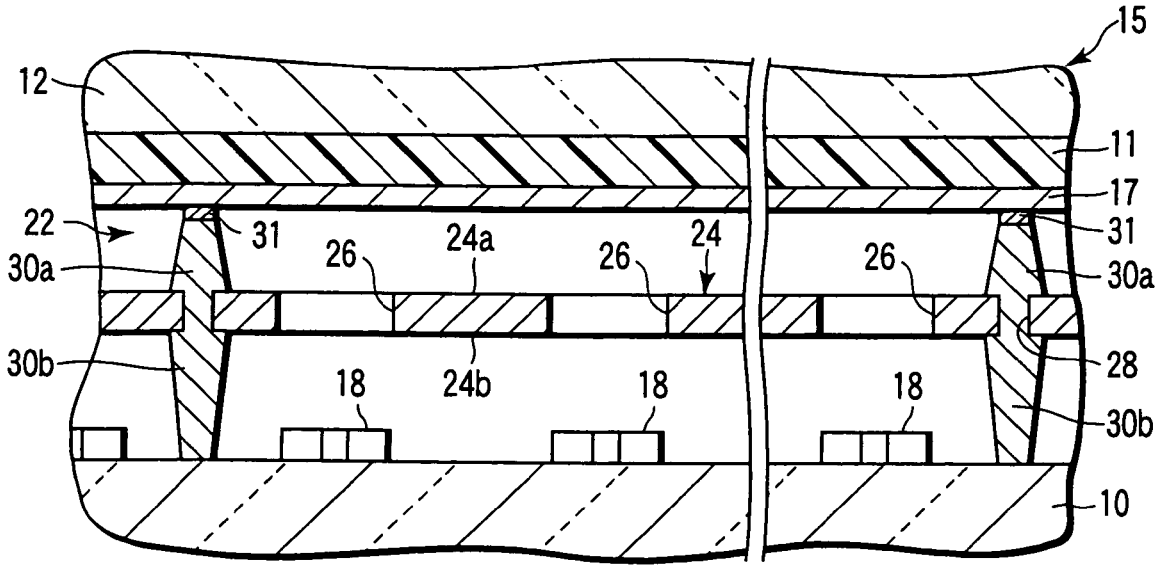
FIG. 5 is an enlarged sectional view of the SED, taken in the Y-direction.

As shown in FIGS. 3 to 5, assuming that the longitudinal direction and width direction of the first and second substrates 12 and 10 are X- and Y-directions, respectively, the electron emitting elements 18 on the second substrate 10 are arranged in the X- and Y-directions at a predetermined pitch P of, for example, 0.62 mm. Similarly, the electron-beam passage apertures 26 in the grid 24 are also arranged in the X- and Y-directions at the same pitch P as the electron emitting elements 18. Further, the phosphor layers R, G and B and black-colored layers 11 of the phosphor screen 16 provided on the first substrate 12 are formed in stripes extending in the X-direction. The phosphor layers R, G and B are positioned in the Y-direction between each pair of adjacent ones of the black-colored layers 11 with the same pitch as that of pixels.

On the other hand, in the Y-direction, the first and second spacers 30*a* and 30*b* are aligned with the electron emitting elements 18 and electron-beam passage apertures 26 at the same pitch of 0.62 mm as the pixel pitch, and are located at the opposite sides of each electron emitting element 18, i.e., each electron-beam passage aperture 26. In the X-direction, the first and second spacers 30*a* and 30*b* are arranged at, for example, 14 times the pixel pitch, i.e., at a pitch of 8.68 mm. As above-mentioned, the first and second spacers 30*a* and 30*b* oppose the black-colored layers 11.

In the SED constructed as described above, in the Y-direction, the first and second spacers 30*a* and 30*b* are located at the opposite sides of each electron emitting element 18 and electron-beam passage aperture 26, so that they hold therebetween an electron beam emitted from each electron emitting element to the phosphor layer. Accordingly, even if the first and second spacers 30*a* and 30*b* are electrically charged, thereby attracting electron beams, the electron beams are prevented from being deviated from their correct paths.

Figure 6:
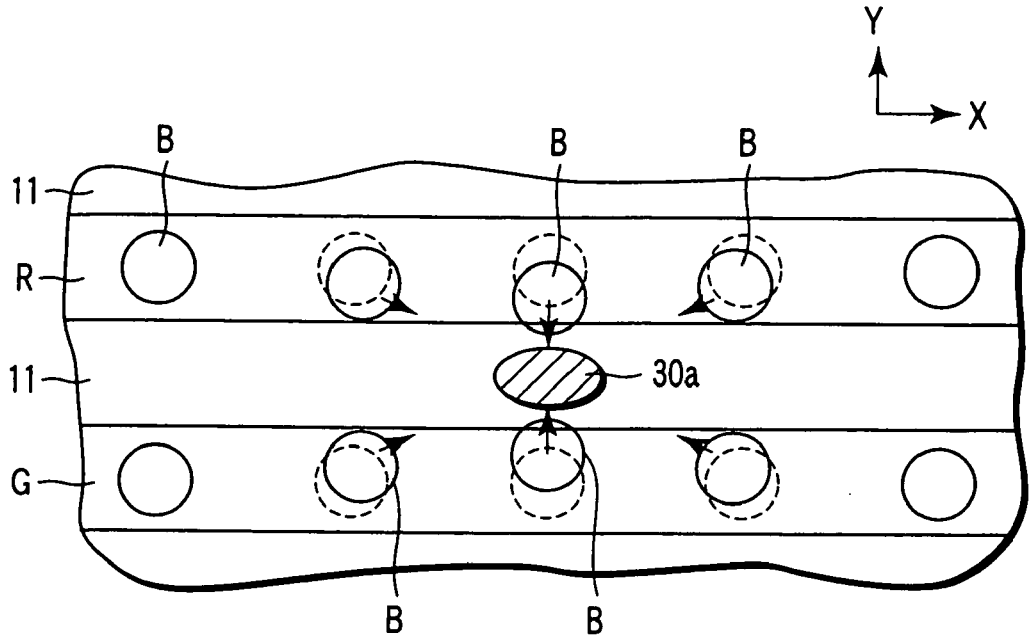
FIG. 6 is a plan view schematically illustrating a state of electron beams landed on a phosphor layer, assumed where spacers are provided only at one side of an electron beam path.
Figure 7:
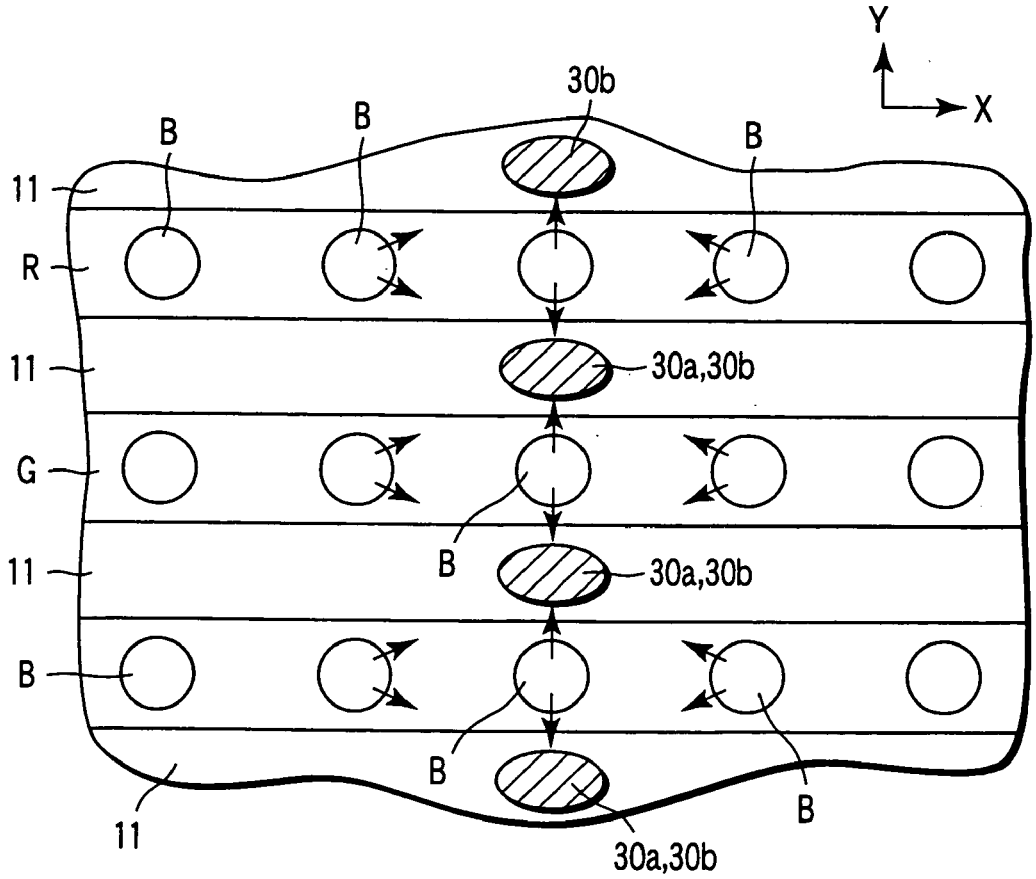
FIG. 7 is a plan view schematically illustrating a state of electron beams landed on a phosphor layer, assumed in the SED of the embodiment.

Specifically, if the first and second spacers 30*a* and 30*b* are provided only at one side of each electron emitting element 18 or electron-beam passage aperture 26, electron beams B are attracted by charged spacers, with the result that the beams may land on the phosphor layers in positions deviated from designed landing positions, as is shown in FIG. 6.

On the other hand, since in the embodiment, the first and second spacers 30*a* and 30*b* are provided at both sides of each electron emitting element 18 and electron-beam passage aperture 26, electron beams B are attracted by both of them, thereby compensating deviation in landing position. In other words, the electron beams can pass through the correct paths and land on desired phosphor layers. As a result, a high-definition SED, in which degradation in color purity due to mislanding of electron beams is reduced, can be obtained.

Furthermore, in the SED according to the embodiment, the surface resistance of the second spacers 30*b* located close to the electron emitting elements 18 is set lower than that of the first spacers 30*a*. Accordingly, the amount of charge accumulated on the second spacers 30*b* can be reduced, thereby reducing a displacement of each electron beam due to the charge accumulated on the second spacers. This enables an image of further enhanced color purity to be displayed.

An SED according to the embodiment, and an SED in which spacers are provided only at one side of each electron emitting element were prepared, and were compared concerning the amounts of displacement of electron beams. In the SED of the embodiment, there were no displacements of electron beams passing near the spacers, and the same color purity as designed could be acquired.

In the above-described SED, the grid 24 is provided between the first and second substrates 12 and 10, and the height of the first spacers 30*a* is set lower than that of the second spacers 30*b*. As a result, the grid 24 is located closer to the first substrate 12 than to the second substrate 10. Therefore, even if the first substrate 12 is discharged, the grid 24 can suppress destruction of the electron emitting elements 18 on the second substrate 10 due to the electric discharge. This enables a high definition SED of high resistance to electric discharge to be produced.

An SED according to the embodiment, and an SED having a spacer assembly in which the first spacers at the first substrate side are longer than the second spacers at the second substrate side were prepared. After these SEDs were operated for 1000 hours, they were compared concerning the destroyed states of the electron emitting elements incorporated therein. From the comparison, it was found that the degree of destruction of the electron emitting elements was lower by 40% in the SED of the embodiment than in the other SED.

Even if the voltage applied to the grid 24 is higher than that applied to the first substrate 12, electrons emitted from the electron emitting elements 18 can be made to reach the phosphor screen reliably by making the first spacers 30*a* provided at the first substrate 12 shorter than the second spacers 30*b* provided at the second substrate 10.

In the SED of the embodiment, the height adjusting layers can absorb any variations in height between the first spacers 30*a*, and enable the first spacers to reliably contact the first substrate 12. Accordingly, the first and second spacers 30*a* and 30*b* can keep a uniform space between the first and second substrates 12 and 10 over substantially the entire region.

Figure 8:
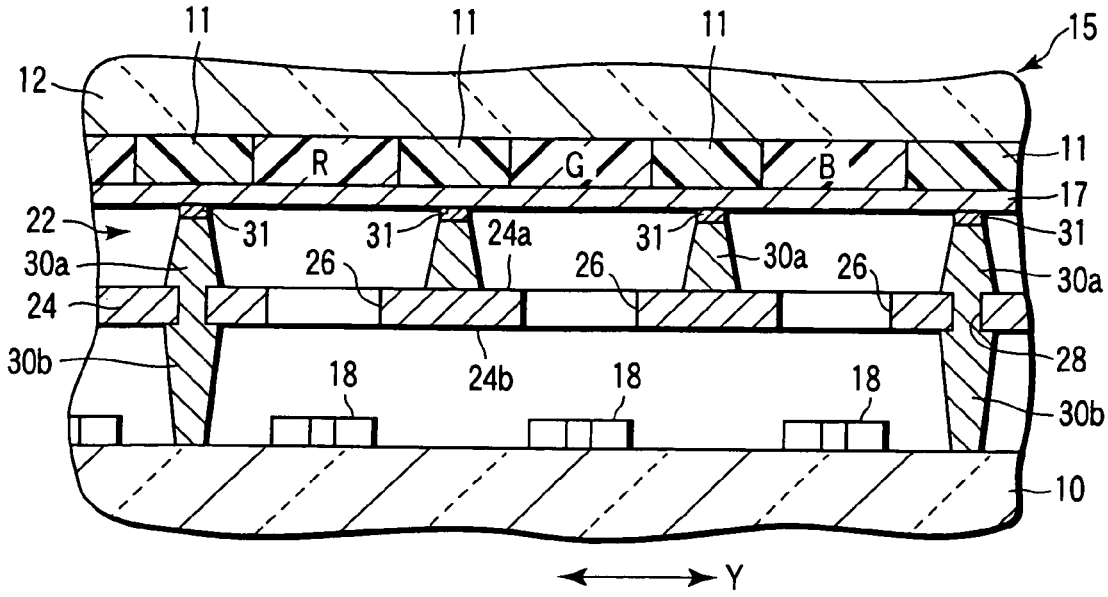
FIG. 8 is an enlarged sectional view illustrating a portion of an SED according to a second embodiment of the invention.

The present invention is not limited to the above-described embodiment, but may be modified in various ways without departing from the scope of the invention. For example, in the embodiment, both the first and second spacers 30*a* and 30*b* are provided in the Y-direction at the opposite sides of each electron beam emitting element 18 and electron-beam passage aperture 26. However, as in the second embodiment shown in FIG. 8, in the Y-direction, only the first spacers 30*a* may be arranged at the same pitch as the pixel pitch, with the second spacers 30*b* arranged at several times the pixel pitch, so that the first spacers are provided at the opposite sides of each electron-beam passage aperture 26 to hold therebetween an electron beam emitted from the corresponding electron emitting element 18.

Figure 9:
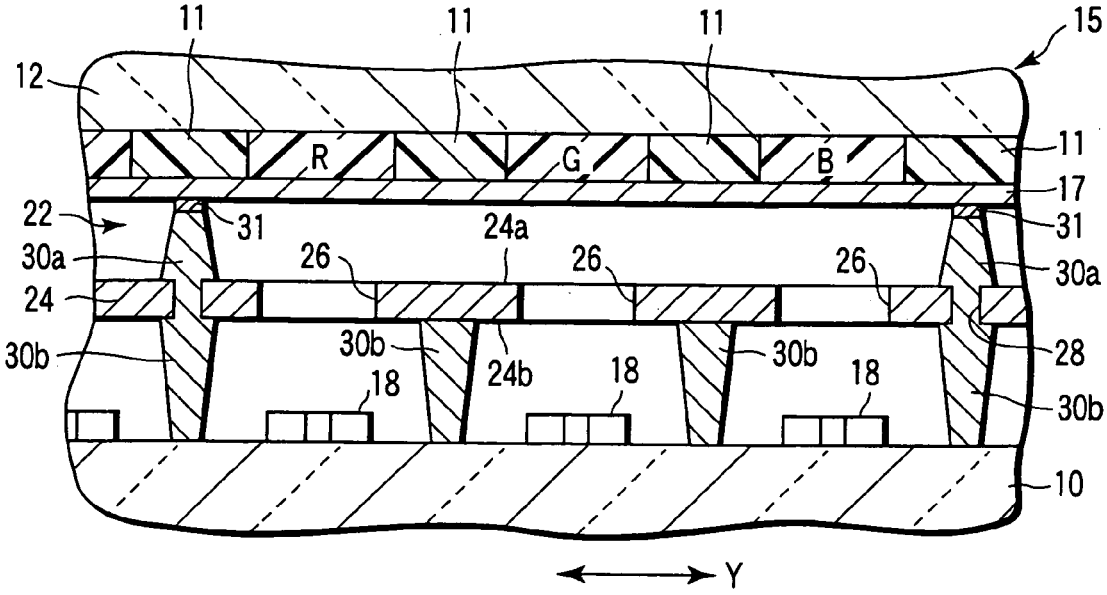
FIG. 9 is an enlarged sectional view illustrating a portion of an SED according to a third embodiment of the invention.

Alternatively, as in the third embodiment shown in FIG. 9, in the Y-direction, only the second spacers 30*b* may be arranged at the same pitch as the pixel pitch, with the first spacers 30*a* arranged at several times the pixel pitch, so that the second spacers are provided at the opposite sides of each electron-beam passage aperture 26 to hold therebetween an electron beam emitted from the corresponding electron emitting element 18.

In any case, a high definition SED, in which a deviation in electron beam path due to charge accumulated on the spacers is reduced, can be acquired as in the first embodiment. In the SEDs shown in FIGS. 8 and 9, the other structure is similar to that of the first embodiment, therefore elements similar to those in the first embodiment are denoted by corresponding reference numerals and the detailed description thereof will be omitted.

It is desirable that in the Y-direction, the first and second spacers be basically arranged at the same pitch as the pixel pitch over the entire image display region. However, in some cases, the first and second spacers may be omitted in part of the image display region.

The present invention is not limited to an image display apparatus equipped with a grid, but is also applicable to an image display apparatus with no grid. In this case, if columnar or plate-shaped spacers formed integral with each other as one body are arranged in the X- and Y-directions in the same manner as in the above-described embodiment, the same advantage as the above can be acquired.

Although in the above embodiments, the longitudinal direction and width direction of the second substrate 10 and first substrate 12 are assumed to be the X- and Y-directions, respectively, the spacers may be arranged on the assumption that the longitudinal direction and width direction are the Y- and X-directions, respectively. In this case, if the phosphor layers and black-colored layers are arranged in stripes, these layers are formed to extend in the width direction Y.

In addition, in the invention, the material of the spacers is not limited to the above-mentioned glass paste, but may be any other appropriate material as needed. Further, the diameter or height of spacers, and the size, material, etc. of any other structural element may be selected if necessary. Furthermore, the material of the high-resistance film provided on the grid surface and the second spacers is not limited to glass, tin oxide or antimony oxide, but may be selected if necessary.

The electron source is not limited to the surface-conduction-type electron emitting element, but may be any appropriate device, such as an electric-field-emission type device or carbon nanotube device. Yet further, the present invention is not limited to the above-described SED, but is applicable even to other image display apparatuses such as FED, PDP, etc.

What is claimed is:

1. An image display apparatus comprising:

a first substrate including an image display surface which has a plurality of phosphor layers and black-colored layers extending in an X-direction;

a second substrate opposing the first substrate with a space therebetween, and including a plurality of electron sources arranged at a predetermined pixel pitch in the X-direction and a Y-direction perpendicular to the X-direction, the electron sources activating the phosphor layers; and a plurality of columnar spacers provided between the first substrate and the second substrate and defining the space therebetween, the spacers being arranged to oppose the black-colored layers;

the plurality of spacers being arranged at several times the pixel pitch in the X-direction, and arranged in the Y-direction at the same pitch as the pixel pitch at least in a part of the image display surface, those of the spacers arranged in the Y-direction at least in the part of the image display surface being arranged in line with the electron sources and being located at both sides of each of the corresponding electron sources to make an electron emitted from each of the corresponding electron sources pass between each adjacent pair of said those spacers.

2. The image display apparatus according to claim 1, wherein the plurality of spacers are arranged at the same pitch as the pixel pitch over an entire image display surface in the Y-direction.

3. An image display apparatus comprising:

a first substrate including an image display surface which has a plurality of phosphor layers and black-colored layers extending in an X-direction;

a second substrate opposing the first substrate with a space therebetween, and including a plurality of electron sources arranged at a predetermined pixel pitch in the X-direction and a Y-direction perpendicular to the X-direction, the electron sources activating the phosphor layers;

a grid including a first surface opposing the first substrate, a second surface opposing the second substrate, and a plurality of apertures opposing the electron sources, the grid being arranged between the first substrate and the second substrate;

a plurality of first columnar spacers projecting from the first surface of the grid, contacting the first substrate, and opposing the black-colored layers; and a plurality of second columnar spacers projecting from the second surface of the grid, and contacting the second substrate, the first spacers and the second spacers being arranged at several times the pixel pitch in the X-direction, at least the first spacers or the second spacers being arranged in the Y-direction at the same pitch as the pixel pitch at least in a part of the image display surface, at least the first spacers or the second spacers arranged in the Y-direction at least in the part of the image display surface being arranged in line with the electron sources and being located at both sides of each of the corresponding electron sources to hold an electron emitted from each of the corresponding electron sources between each adjacent pair of at least the first spacers or the second spacers.

4. The image display apparatus according to claim 3, wherein at least the first spacers or the second spacers are arranged at the same pitch as the pixel pitch over an entire image display surface in the Y-direction.

5. The image display apparatus according to claim 3, wherein in the Y-direction, the first spacers and the second spacers are arranged at the same pitch as the pixel pitch, and the first spacers, the second spacers and the electron sources are arranged in line.

6. The image display apparatus according to claim 3, wherein in the Y-direction, the first spacers are arranged at the same pitch as the pixel pitch and in line with the electron sources, and the second spacers are arranged at several times the pixel pitch in the Y-direction.

7. The image display apparatus according to claim 3, wherein in the Y-direction, the second spacers are arranged at the same pitch as the pixel pitch and in line with the electron sources, and the first spacers are arranged at several times the pixel pitch in the Y-direction.

8. The image display apparatus according to claim 3, wherein the first spacers have a height lower than the second spacers.

9. The image display apparatus according to claim 3, wherein each of the first spacers contacts the first substrate via a height adjusting layer.

10. The image display apparatus according to claim 3, wherein the first surface and the second surface of the grid and an inner surface of each aperture are subjected to high-resistance surface processing.

11. The image display apparatus according to claim 3, further comprising a voltage apply unit which supplies different voltages to the grid and the first substrate.

* * * * *